US007486912B2

(12) United States Patent
Maeda

(10) Patent No.: US 7,486,912 B2
(45) Date of Patent: Feb. 3, 2009

(54) IMAGE FORMING APPARATUS WITH AN EXTERIOR COVER OPERABLE TO ACTUATE A RELEASING MECHANISM AND TO SERVE AS A HANDLE

(75) Inventor: Hiroyuki Maeda, Osaka (JP)

(73) Assignee: Kyocera Mita Corporation (JP)

( * ) Notice: Subject to any disclaimer, the term of this patent is extended or adjusted under 35 U.S.C. 154(b) by 230 days.

(21) Appl. No.: 11/494,409

(22) Filed: Jul. 27, 2006

(65) Prior Publication Data

US 2007/0025764 A1 Feb. 1, 2007

(30) Foreign Application Priority Data

Jul. 29, 2005 (JP) ..... 2005-220016

(51) Int. Cl.
*G03G 15/16* (2006.01)
*G03G 15/00* (2006.01)

(52) U.S. Cl. ..... 399/122; 399/110

(58) Field of Classification Search ..... 399/110, 399/122, 320

See application file for complete search history.

(56) References Cited

U.S. PATENT DOCUMENTS

2004/0190939 A1 * 9/2004 Yamanaka ..... 399/122

FOREIGN PATENT DOCUMENTS

| | | |
|---|---|---|
| JP | 8-44131 | 2/1996 |
| JP | 2003-241615 | 8/2003 |

* cited by examiner

*Primary Examiner*—Hoang Ngo
(74) *Attorney, Agent, or Firm*—Gerald E. Hespos; Anthony J. Casella

(57) ABSTRACT

An image forming apparatus includes: a main body; a unit withdrawably mounted in the main body; an exterior cover attached on a front face of the unit; a rail carrying the unit, the rail being withdrawable outwardly from the main body; a rail guide member for supporting the rail slidably; a locking mechanism for restricting movement of the unit and the rail; and a releasing mechanism for releasing the restriction of the locking mechanism. In the image forming apparatus, the exterior cover is operable to actuate the releasing mechanism and serve as a handle for the unit.

9 Claims, 6 Drawing Sheets

IMAGE FORMING APPARATUS WITH AN EXTERIOR COVER OPERABLE TO ACTUATE A RELEASING MECHANISM AND TO SERVE AS A HANDLE

BACKGROUND OF THE INVENTION

1. Field of the Invention

The invention relates to image forming apparatuses such as a copying machine and a printer. More particularly, it relates to an image forming apparatus comprising a unit withdrawably mounted in an apparatus main body.

2. Description of the Related Art

There exists a known image forming apparatus in which a fixing unit including members for performing fixing of a toner image to a recording sheet and is withdrawably mounted in an apparatus main body. In such apparatus, a locking mechanism is provided so as to restrict a movement of the fixing unit at the time when such movement is not needed. However, in a conventional technology, an operation lever for unlocking the locking mechanism provided in the fixing unit had been such a large part extending in a longitudinal direction of the fixing unit that space-saving in the image forming apparatus was prevented.

In view of the above, a various kinds of locking mechanisms which are compact and easy in operation for locking the fixing unit have been proposed. For example, in a construction disclosed in Japanese Unexamined Patent Publication No. HEI8-44131, a movable body which is connected rotatably to a main body of an image forming apparatus by a hinge is provided, and a predetermined locking engaging member is provided in the movable body on which the fixing device is mounted and in the main body of the image forming apparatus. Further, in Japanese Unexamined Patent Publication No. 2003-241615, a fixing device including a cover member serving as a handle gripped at the time of moving the fixing device and as an operating portion of the locking mechanism is disclosed.

However, in the construction disclosed in the Japanese Unexamined Patent Publication No. HEI8-44131, strength of the exterior cover is likely to be lowered since a part of the exterior cover is cut off and an operation lever for the locking mechanism is provided therein. Consequently, it would be necessary to add strength separately, or the part itself becomes larger and may prevent downsizing of the apparatus.

Further, in a construction disclosed in the Japanese Unexamined Patent Publication No. 2003-241615, a fixing cover is separately provided at an inner part of the exterior cover of the apparatus. Therefore, a user may be required to withdraw the fixing device by gripping the fixing cover after opening the exterior cover. It increases a number of operations needed for withdrawing the fixing device. Further, in the case of an image forming apparatus provided with a sheet conveyance passage between the fixing unit and the exterior cover, the operating lever of the locking mechanism prevents a conveyance of a recording sheet. Furthermore, there was a problem that a space between the exterior cover and the fixing unit for treating operation of sheet jamming becomes narrow.

SUMMARY OF THE INVENTION

In view of the above-described problems, an object of the present invention is to provide an image forming apparatus including a withdrawing mechanism and a locking mechanism for a unit which saves a space and is excellent in operability.

The image forming apparatus according to an embodiment of the present invention accomplishing the object comprises: a main body; a unit withdrawably mounted in the main body; an exterior cover attached on a front face of the unit; a rail carrying the unit, the rail being withdrawable outwardly from the main body; a rail guide member for supporting the rail slidably; a locking mechanism for restricting movement of the unit and the rail; and a releasing mechanism for releasing the restriction of the locking mechanism, wherein the exterior cover is operable to actuate the releasing mechanism and serve as a handle for the unit.

According to the construction, the exterior cover which constitutes a part of an exterior surface of the apparatus main body serves as a member for actuating the releasing mechanism of the locking mechanism of the unit and as a handle portion for withdrawing the unit from the main body of the apparatus. Thus, it becomes easier to withdraw the unit, and it would not be necessary to provide a separate operating lever for releasing the locking mechanism. Accordingly, it contributes to reducing of a number of parts and downsizing of the apparatus.

BRIEF DESCRIPTION OF THE DRAWINGS

FIG. 3 is a perspective view showing a construction of a vicinity of an exterior cover in a state where the fixing unit is mounted in.

FIG. 4 is a side view showing a vicinity of the exterior cover in the state where the fixing unit is mounted in.

DETAILED DESCRIPTION OF THE PREFERRED EMBODIMENTS

Hereinafter, an embodiment of the invention is described with reference to drawings.

Figure 1:
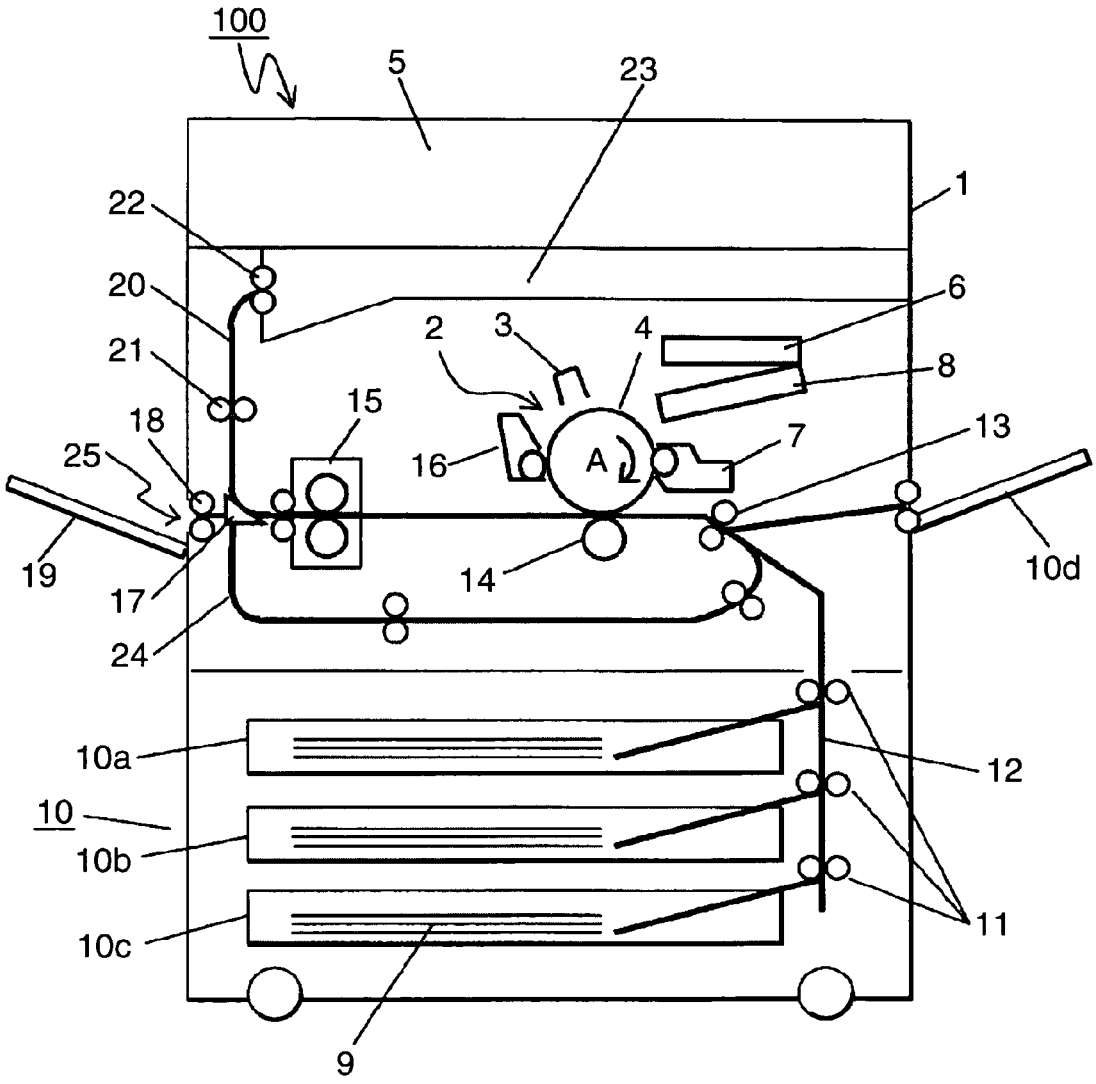
FIG. 1 is a front sectional view for describing an internal structure of an image forming apparatus according to an embodiment of the invention.

FIG. 1 is a front sectional view for describing an internal structure of an image forming apparatus 100 according to an embodiment of the invention. In the present embodiment, a digital composite machine is described as an example of the image forming apparatus 100.

The image forming apparatus includes in its apparatus main body 1 an image forming section 2 for transferring an image onto a recording sheet 9, a sheet feeding mechanism 10 for storing a stack of the recording sheets 9 and feeding the recording sheets 9 to the image forming section 2, a fixing unit 15 for fixing an image onto the recording sheet 9 to which a transfer of the image is executed in the image forming section 2 and an image reading section 5 for reading out a document image.

The sheet feeding mechanism 10 is detachably mounted in the apparatus main body 1 and includes a plurality of sheet feeding cassettes 10*a*, 10*b*, 10*c* for storing recording sheets 9 and a stack bypass (manual feeding tray) 10*d* provided in upper part of the sheet feeding cassettes 10*a*, 10*b*, 10*c*. The recording sheets 9 stored in the sheet feeding cassette 10*a*, 10*b*, 10*c* are sent out by a sheet feeding roller 11 one after another and fed to the image forming section 2 through a sheet conveyance passage 12 and a pair of registration rollers 13.

The image forming section 2 executes transferring process to the recording sheets 9 based on image data read out in the image reading section 5 or electrically transferred from a computer and the like. The image forming section 2 includes a photoconductive drum 4 mounted rotatably about a shaft (direction A indicated by an arrow in FIG. 1) extending in forward and backward directions (direction perpendicular to a sheet of FIG. 1) of the apparatus. Further, a charging unit 3, an exposing unit (laser scanning unit and the like) 8, a developing unit 7, a transferring roller 14 and a cleaning device 16 are provided successively around the photoconductive drum 4.

On a peripheral surface of the photoconductive drum 4, an electrostatic latent image and a toner image based on the electrostatic latent image are formed. For the photoconductive drum 4, a drum on which a layer of amorphous silicon is formed can be preferably used.

The charging unit 3 charges an electric charge on the peripheral surface of the photoconductive drum 4 which is rotated in a direction of the arrow A about the shaft. The charging unit 3 applies electric charge on the peripheral surface of the photoconductive drum 4 by a corona charge. In place of the charging unit 3, the charging roller may be adopted.

The exposing unit 8 irradiates a laser light ray having a proper strength based on an image data to be formed to the peripheral surface of the photoconductive drum 4. The irradiated laser light ray erases an electric charge on the photoconductive drum 4 so as to form the electrostatic latent image on the peripheral surface of the photoconductive drum 4.

The developing unit 7 feeds a developer (hereinafter, referred to as toner particles) to the peripheral surface of the photoconductive drum 4 to thereby attach toner particles to portions of the peripheral surface on which the electrostatic latent image is formed. Accordingly, a toner image is formed on the peripheral surface of the photoconductive drum 4. The toner particles are supplied to the developing unit 7 from a toner container 6.

The transferring roller 14 makes the positively charged toner image formed on the peripheral surface of the photoconductive drum 4 transferred to the recording sheet 9 sent to the peripheral surface of the photoconductive drum 4. To realize this operation, the transferring roller 14 applies negative electric charge having an inversed polarity with respect to the electric charge of the toner image to the recording sheet 9. Thus, the recording sheet 9 sent to an immediately downward position of the photoconductive drum 4 is negatively charge while being pressingly nipped by the transferring roller 14 and the photoconductive drum 4, and then the toner image on the positively charged peripheral surface of the photoconductive drum 4 is peeled off toward the surface of the recording sheet 9. Accordingly, the transferring process of the toner image to the recording sheet 9 is performed.

The cleaning device 16 cleans up toner particles or other attached object resided on the peripheral surface of the photoconductive drum 4 after the transferring process. In the cleaning device 16, a cleaning roller which comes in contact with the peripheral surface of the photoconductive drum 4 is provided. By a rotation of the cleaning roller, the resided toner particles and objects attached on the photoconductive drum 4 are cleaned. A portion of the peripheral surface of the photoconductive drum 4 cleaned by the cleaning device 16 moves to the charging unit 3 again for the next image forming process.

The fixing unit 15 is adapted for fixing the toner image transferred to the recording sheet 9 in the image forming section 2 by heat. The fixing unit 15 includes a fixing roller for applying heat to the recording sheet 9 and a pressing roller facing the fixing roller. After the transferring process, the recording sheet 9 is sent to a nip portion formed between the fixing roller and the pressing roller. By passing through the nip portion, the recording sheet 9 receives heat from the fixing roller so that the fixing process is executed thereto.

After passing through the fixing unit 15, a conveyance direction of the recording sheet 9 is directed to either one of the conveyance passages branched off in a plurality of directions by a branching member 17. In the case of forming the image only on one side of the recording sheet 9, the recording sheet 9 passes through a pair of side discharging rollers 18 and is discharged onto a sheet discharging tray 19 in a state where the image surface of the recording sheet 9 is kept facing upward (face up). Or, the recording sheet 9 is conveyed to a sheet conveyance passage 20 extending in upward direction by the branching member 17 and discharged to the intermediate discharging tray 23 through a pair of intermediate discharging rollers 22 in a state where the image surface of the recording sheet 9 is kept facing downward (face-down). The sheet conveyance passage 20, the pair of conveyance rollers 21 and the pair of intermediate discharging rollers 22 serves also as a switchback device for switching a conveyance direction of the recording sheet 9.

On the other hand, in the case of forming images on both sides of the recording sheet 9, after passing through the fixing unit 15, the recording sheet 9 is conveyed to the sheet conveyance passage 20 by the branching member 17. Then, after a rear end of the recording sheet passes through the branching member 17, the pair of conveyance rollers 21 and the pair of intermediate discharging rollers 22 are rotated reversely so that the conveyance direction is switched. Thereafter, the recording sheet 9 is conveyed to a double-face printing passage 24 by the branching member 17 and conveyed to the image forming section 2 again in the state where a side of the recording sheet 9 not being formed an image faces upward. On the recording sheet 9 conveyed again to the image forming section 2, the next image is formed. Then, the recording sheet 9 is conveyed to the fixing unit 15, and the image formed on the recording sheet 9 is fixed. Thereafter, the recording sheet 9 is discharged to outside of the apparatus by the pair of side discharging rollers 18 or by the pair of intermediate discharging rollers 22.

In such image forming apparatus 100 as described above, the fixing unit 15 is mounted in the apparatus main body 1 withdrawably in a direction parallel to the sheet conveyance direction. Consequently, even in the case where the recording sheet 9 is jammed in a vicinity of the fixing unit 15, the recording sheet 9 can be removed easily.

Figure 2:
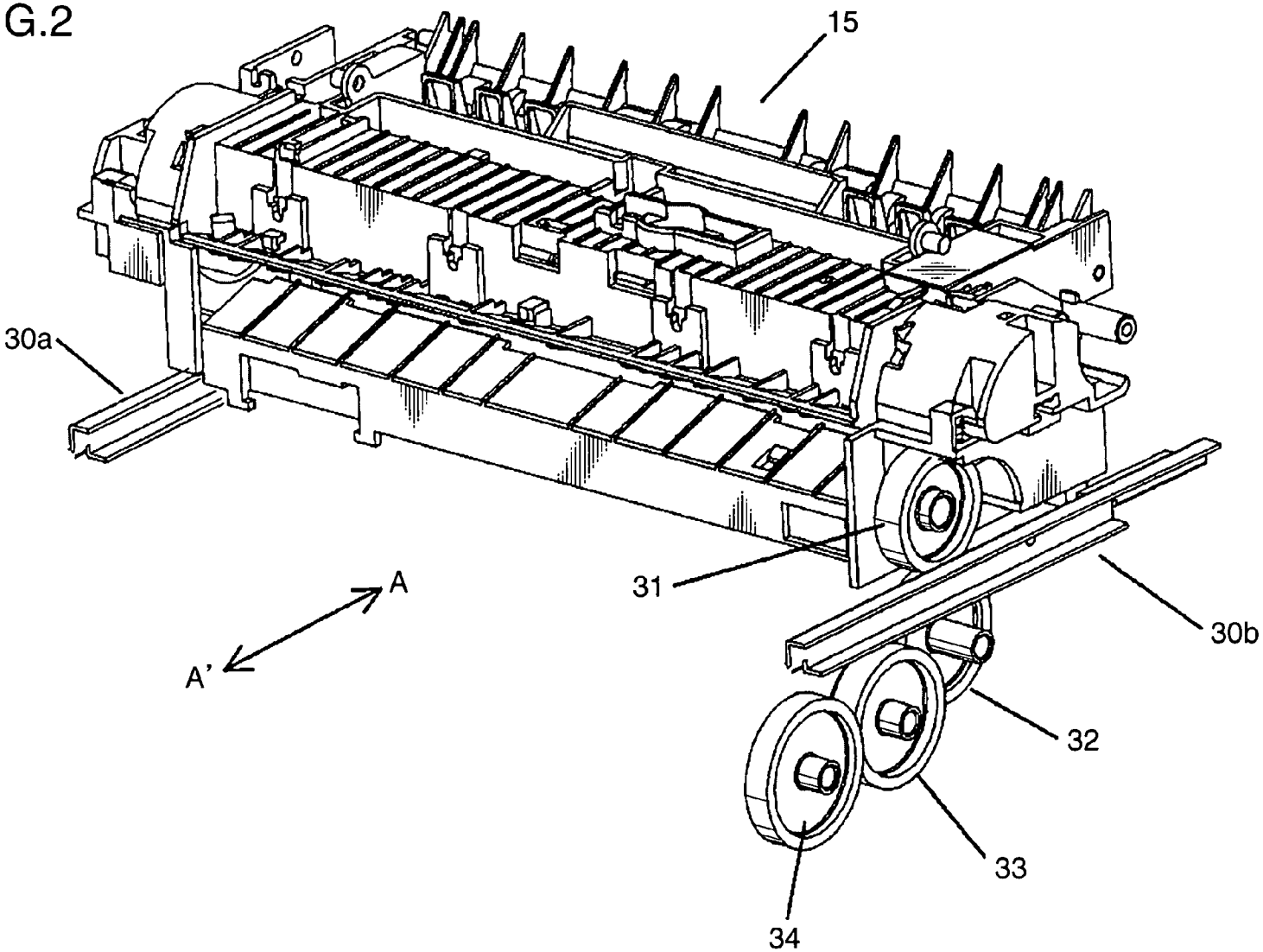
FIG. 2 is a perspective view showing an example of a fixing unit.

FIG. 2 is a perspective view showing the fixing unit 15 withdrawably mounted. As shown in FIG. 2, the main body of the fixing unit 15 (including the fixing roller, the pressing roller and the like) is placed on two rails 30*a*, 30*b*. The rails 30*a*, 30*b* are slidable in a horizontal direction along an unillustrated rail guide provided in one side of the apparatus main body 1 (directions of arrow A-A'). The fixing unit 15 is provided with a fixing input gear 31 and driving gears 32, 33, 34 as a driving system. The driving gears 32, 33, 34 are adapted for transmitting a driving force generated by an unillustrated fixing driving motor (driving means) to the fixing input gear 31.

In the case where a sheet jamming occurs in a vicinity of a mounting portion of the fixing unit 15, the fixing unit 15 is withdrawn together with the rails 30*a*, 30*b* by a user in the direction A from the apparatus main body 1. Accordingly, the fixing input gear 31 is detached from the gear 32 so that driving of the fixing unit 15 is stopped. Then, after the jamming is treated and the fixing unit 15 is inserted toward the direction of the arrow A', the fixing input gear 31 is engaged with the gear 32.

Figure 3:
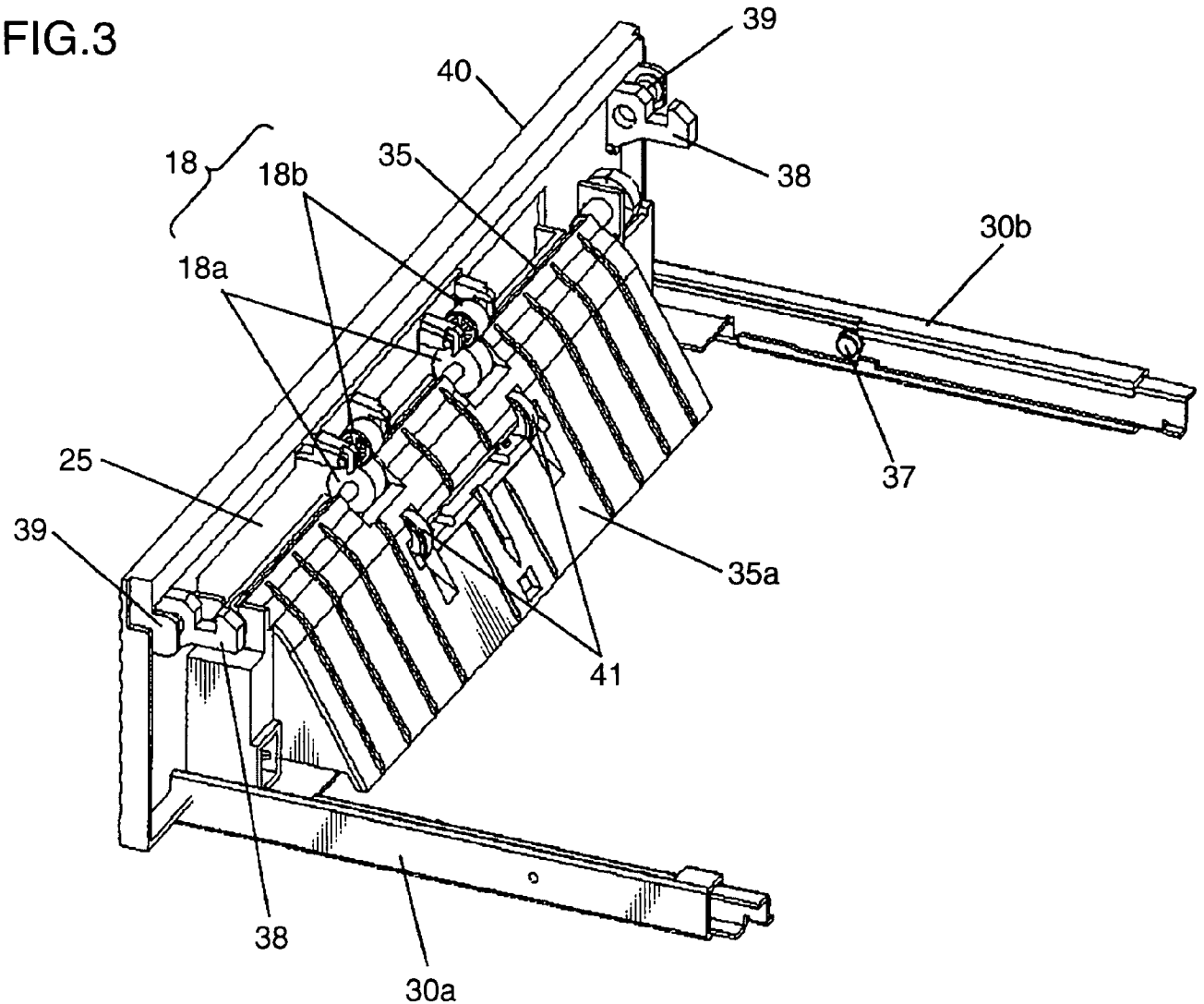
Figure 4:
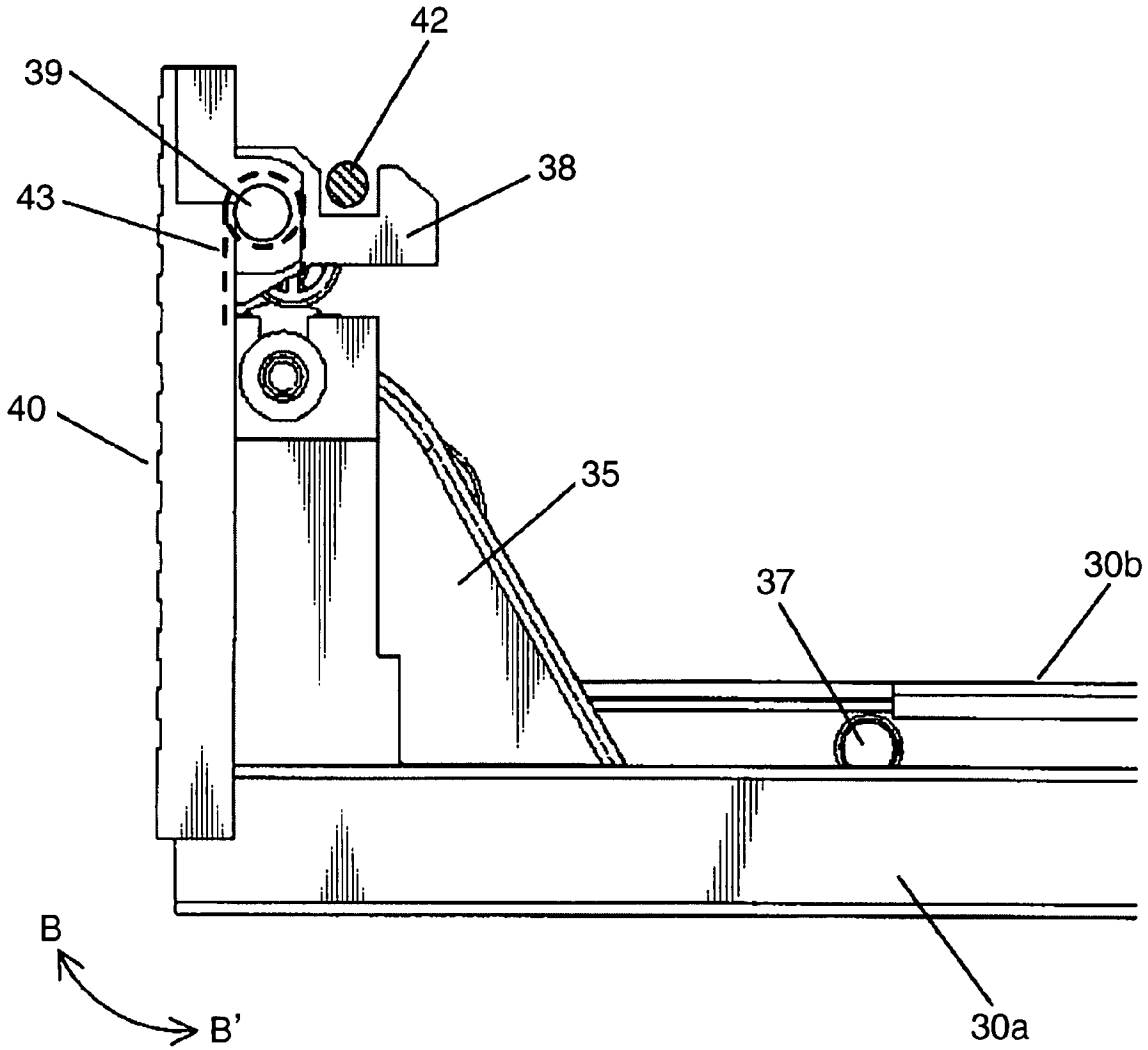

Next, a withdrawing mechanism and a locking mechanism of the fixing unit 15 are specifically described. FIG. 3 is a perspective view in a view point from inner part of the apparatus showing a construction of a vicinity of an exterior cover in the state where the fixing unit 15 is mounted in. FIG. 4 is a side view showing a vicinity of the exterior cover in the state where the fixing unit 15 is mounted in. For convenience in description, a main body of the fixing unit 15 (refer to FIG. 2) is not illustrated in FIGS. 3 and 4.

In addition to the main body and the rails 30*a*, 30*b* shown in FIG. 2, the fixing unit 15 includes a conveyance guide member 35. Further, an exterior cover 40 constituting a part of the external surface of the apparatus main body 1 is attached on an outer side of the conveyance guide member 35 (a front face of the fixing unit 15).

The conveyance guide member 35 is a guide member (described as a branching member 17 in FIG. 1) for guiding the recording sheet 9 which has passed through a fixing roller of the fixing unit 15 to the sheet conveyance passage 20, the opposite sides printing passage 24 (refer to FIG. 1) or a side discharging portion 25 provided in an exterior cover 40. The conveyance guide member 35 is fixed on leading edges of the two rails 30*a*, 30*b* so as to bridge the rails.

On the conveyance guide member 35, a side discharging roller 18*a* is provided. The side discharging roller 18*a* is rotated in a sheet discharging direction by an unillustrated driving means. A pair of side discharging rollers 18 are constructed by the side discharging roller 18*a* and a discharging roller 18*b*. The discharging roller 18*b* pressingly comes in contact with the side discharging roller 18*a* provided in the exterior cover 40 and is rotationally driven. On a sheet conveyance surface 35*a* of the conveyance guide member 35, a guide roller 41 for smoothly conveying the recording sheet is provided.

The exterior cover 40 does not only constitutes a mere part of an exterior surface of the apparatus main body 1 but also serves as a handle used in a case of withdrawing the fixing unit 15 from the apparatus main body 1 or in a case of mounting the fixing unit 15 in the apparatus main body 1.

On upper portions of opposite ends of the exterior cover 40, a pair of a hooking member 38 projects toward inner part of the apparatus main body 1. The hooking member 38 and an engaging pin 42 provided on a side of the apparatus main body 1 constitute the locking mechanism. Namely, the hooking member 38 engages with the engaging pin 42 so that a movement of the fixing unit 15 and the rails 30*a*, 30*b* in a horizontal direction is restricted.

The exterior cover 40 is rotatably attached to the conveyance guide member 35 with a rotational movement supporting point 39 projecting from inner surface of the hooking member 38. Accordingly, the exterior cover 40 is rotated in directions of arrows B-B' together with the hooking member 38. In other words, the exterior cover 40 is shiftable over a vertical posture (a first posture as referred to FIGS. 3 and 4) and a rotated posture (a second posture as referred to FIGS. 5 and 6). In the vertical posture, an entirety of the exterior cover 40 comes close to the conveyance guide member 35 (the fixing unit 15) so that the exterior cover 40 is not rotated substantially. In the rotational posture, the exterior cover 40 is rotated a predetermined angle about a rotational movement supporting point 39 from the vertical posture so that a lower portion of the exterior cover 40 is separated from the conveyance guide member 35. The exterior cover 40 serves also as a releasing lever (releasing mechanism) for releasing the engagement of the hooking member 38 and the engaging pint 42 by its rotation. Further, the exterior cover 40 is biased in a direction of the arrow B' by a torsion spring 43 provided in the rotational movement supporting point 39.

Figure 5:
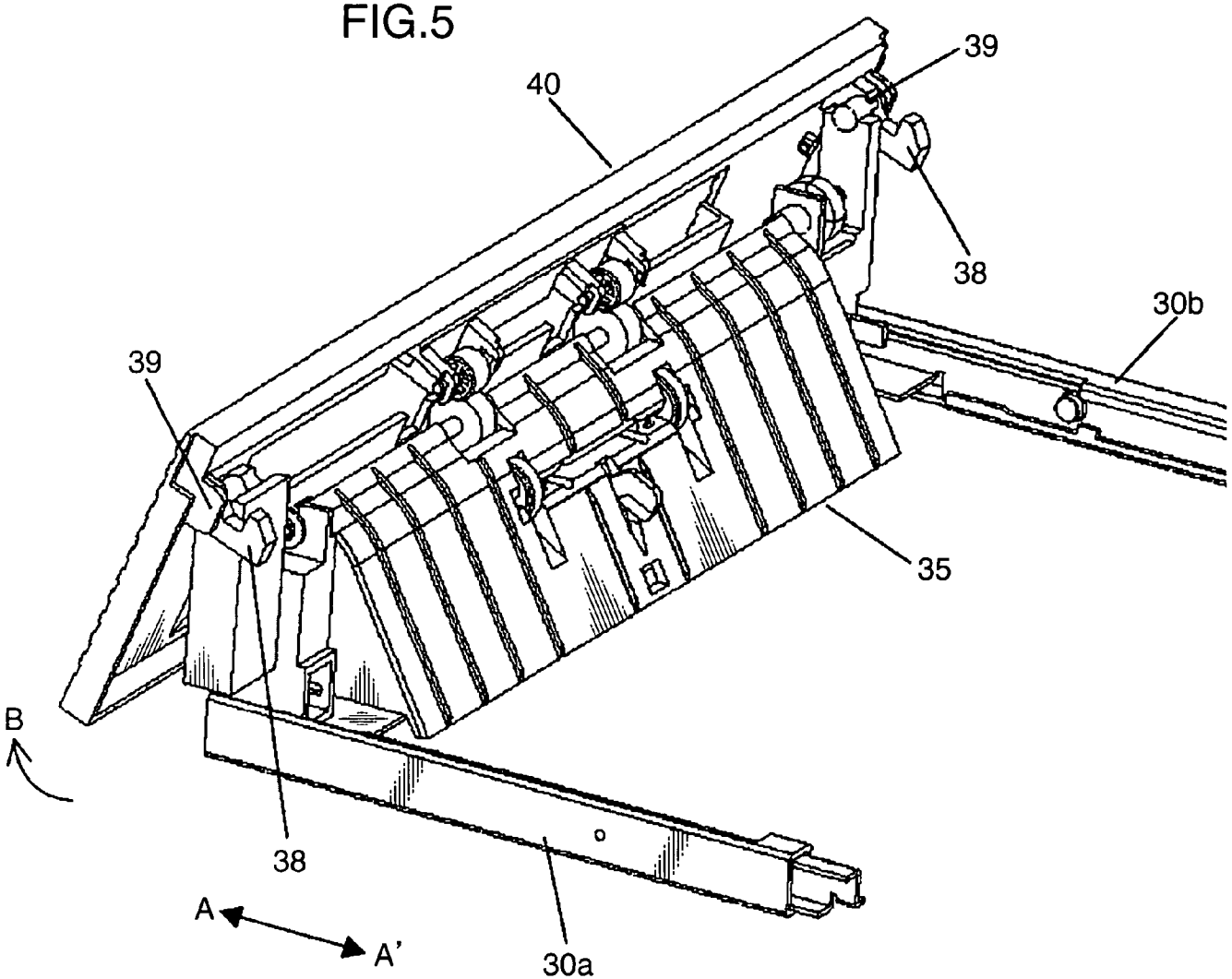
FIG. 5 is a perspective view showing a construction of a vicinity of the exterior cover in a state where the fixing unit is withdrawn.
Figure 6:
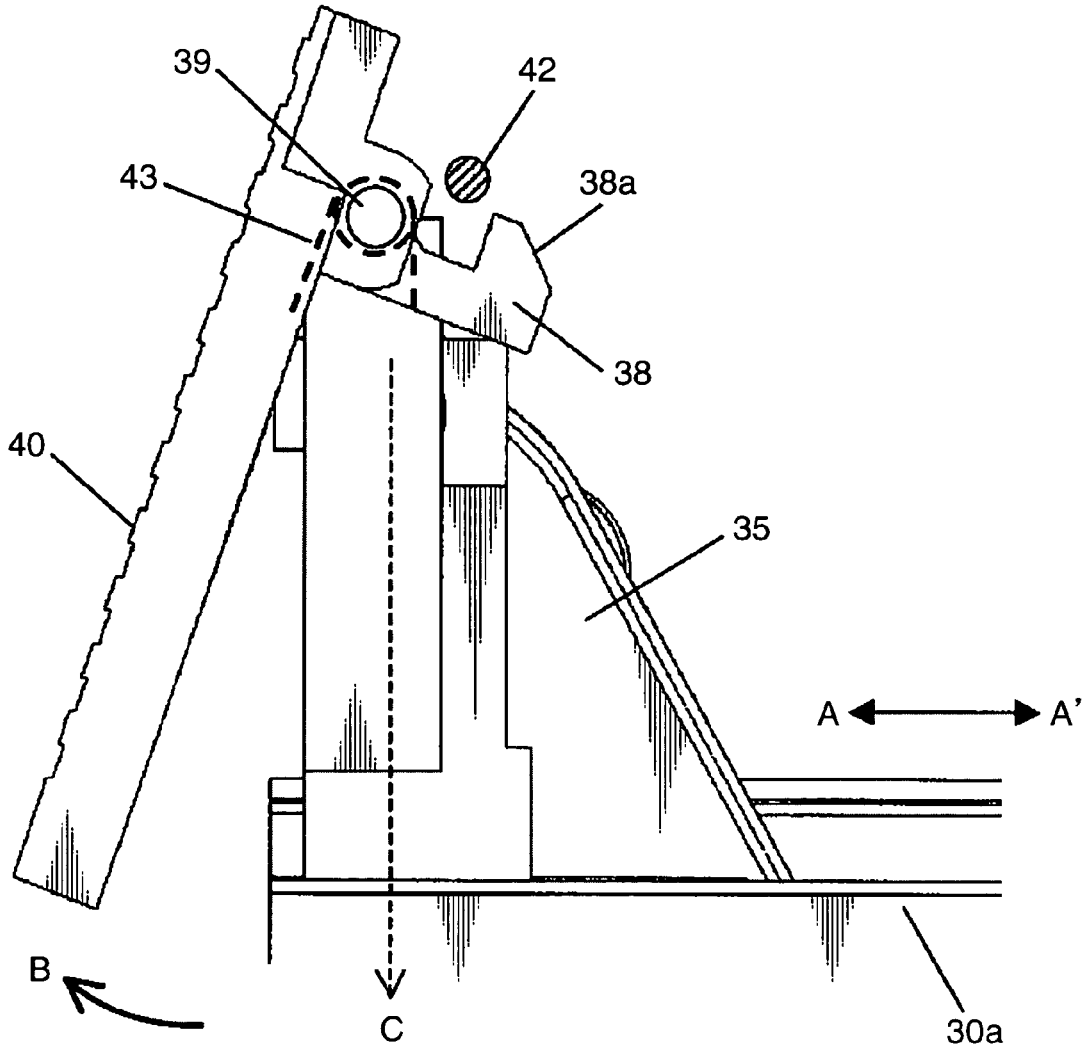
FIG. 6 is a side view showing a vicinity of the exterior cover in the state where the fixing unit is withdrawn.

FIG. 5 is a perspective view in a view point from an inner part of the apparatus showing a construction of a vicinity of the exterior cover 40 in the state where the fixing unit 15 is withdrawn. FIG. 6 is a side view showing the state same as that of FIG. 5. A withdrawing mechanism of the fixing unit 15 is specifically described with reference to these Figures. At first, if the user grasps the lower end portion of the exterior cover 40 to withdraw the fixing unit 15, the exterior cover 40 is rotated a predetermined angle in a direction of the arrow B about the rotational movement supporting point 39 while resisting against the biasing force generated by the torsion spring 43.

With the rotational movement of the exterior cover 40, the hooking member 38 is also rotated a predetermined angle in a direction of the arrow B. Accordingly, as shown in FIG. 6, the engagement of the hooking member 38 and the engaging pin 42 is released. Consequently, the fixing unit 15 and the rails 30*a*, 30*b* become movable in a horizontal direction. Thus, by grasping the exterior cover 40 and withdrawing the same in a direction of the arrow A, the fixing unit 15 is withdrawn with the rails 30*a*, 30*b* outwardly from the apparatus main body 1.

Namely, the exterior cover 40 is so constructed as to serve as a handle for withdrawing the fixing unit 15 and as a releasing lever for the locking mechanism. Accordingly, components of the locking mechanism can be reduced and placed in a space-conserving manner. Further, since it is not necessary to form notches and the like in the exterior cover 40, strength and the design of the exterior cover 40 is improved. Furthermore, since the locking mechanism can be released while the exterior cover 40 is grasped, operability of the fixing unit 15 at the time of withdrawing the exterior cover 40 is improved.

Since the fixing unit 15 is withdrawn together with the rails 30*a*, 30*b*, the user can easily treat jamming occurred in a vicinity of the fixing unit 15 and replace the fixing unit 15. Further, in the case where the double-face printing passage 24 is provided between the conveyance guide member 35 and the exterior cover 40 (an arrow C in FIG. 6), the user can easily treat jamming occurred in a vicinity of the double-face printing passage 24 by rotating the exterior cover 40 in a direction of the arrow B.

If the fixing unit 15 is inserted toward the inner part of the apparatus main body 1, at first, an inclined surface 38*a* of a leading end of the hooking member 38 runs upon the engaging pin 42 and then the rotates in a direction of the arrow B. Then, when the fixing unit 15 is mounted at a predetermined position, the inclined surface 38*a* gets over the engaging pin 42. Thus, the hooking member 38 is rotated in the direction of the arrow B' by the torsion spring 43 and is engaged with the engaging pin 42. Accordingly, the locking mechanism can be actuated by only pressing the exterior cover 40 in a direction of the arrow A' so that operability at the time of inserting the fixing unit 15 is improved.

Further, as long as it is so constructed that the hooking member 38 is rotated in accordance with a rotation of the exterior cover 40 in the same direction, it is not necessarily the case that the rotational movement supporting point of the exterior cover 40 and the hooking member 38 are made the same. For example, the hooking member 38 may be provided in a side of a rotational edge of the exterior cover 40. In such a case, the engaging pin 42 on the side of the apparatus main body 1 is placed in accordance with a position of the hooking member 38.

Furthermore, the rotational movement supporting point 39 of the exterior cover 40 and of the hooking member 38 is provided on an upper end of the exterior cover 40 herein so that the fixing unit 15 is withdrawn by grasping a lower end of the exterior cover 40. In place of this construction, the rotational movement supporting point 39 can be provided at a lower end of the exterior cover 40 so as to make the upper end portion a handle. In such a case, the hooking member 38 may be positioned so that opening faces downward. Accordingly, engagement of the hooking member 38 and the engaging pin 42 is released by a rotation of the upper end of the exterior cover 40.

Furthermore, there is no limit on a rotational angle of the exterior cover 40 as long as the angle is larger than the value at which the engagement between the hooking member 38 and the engaging pin 42 is released. However, if the rotational angle is too large, operability at the time of withdrawing the fixing unit 15 by grasping the exterior cover 40 gets worse. Thus, it is preferable that the angle is set to be a minimum value at which the engagement between the hooking member 38 and the engaging pin 42 can be released.

The present invention is not limited to the embodiments described above, and other various modifications can be made within an area not departing from a purpose of the invention. For example, in the embodiment, the image forming apparatus 100 having a construction of withdrawing the fixing unit 15 horizontally in the sheet conveyance direction is described. However, the unit which is withdrawn outwardly from the apparatus is not limited to the fixing unit 15. For example, it may be other unit such as a transferring unit including a transferring roller 14. Further, it may be so constructed that the fixing unit 15 is withdrawn together with other units.

Further, in the above-described embodiment, the case where the exterior cover 40 is rotatably attached to the conveyance guide member 35 and is biased by the torsion spring 43 is described. However, other biasing member such as a coil spring and a plate spring may be used in place of the torsion spring 43. In the case of making the hooking member 38 engaged with the engaging pin 42 manually at the time of inserting unit, it may be so constructed that a biasing means is not provided. There is no special limitation on a mounting position of the exterior cover 40 as long as the member is fixed on the rails 30*a*, 30*b* and is withdrawn together with the rails 30*a*, 30*b*. The exterior cover 40 may be attached to a member other than the conveyance guide member 35.

Further, the present invention can be applied not only to the digital composite machine but also to an intermediate transferring color image forming apparatus in which toner images of respective colors are transferred on a recording sheet at one time after the color images are successively superimposed on a transferring belt. Furthermore, the present invention can be certainly applied to other types of imaging forming apparatuses such as an analog copying machine, a facsimile machine and a laser printer. In the intermediate transferring color image forming apparatus, it may be so constructed that the intermediate transferring roller is withdrawn in a sheet conveyance direction solely or with the fixing unit 15.

As described above, the image forming apparatus according to the present invention includes: a main body; a unit withdrawably mounted in the main body; an exterior cover attached on a front face of the unit; a rail carrying the unit, the rail being withdrawable outwardly from the main body; a rail guide member for supporting the rail slidably; a locking mechanism for restricting movement of the unit and the rail; and a releasing mechanism for releasing the restriction of the locking mechanism, wherein the exterior cover is operable to actuate the releasing mechanism and serves as a handle for the unit.

Accordingly, an image forming apparatus in which a withdrawing operation of the unit can be operated without operating an operation lever and the like. Further, there is no necessity to provide an operation lever and the like for releasing the restriction of the locking mechanism. Consequently, number of components of the locking mechanism can be reduced and a space can be saved so that the image forming apparatus becomes compact and good in design.

In the above described construction, it is preferable that: the exterior cover is shiftable over a first posture and a second posture different from the first posture against the unit; and the locking mechanism includes a hooking member projecting on an inner surface of the exterior cover and an engagement member provided in the main body, the engagement member being engageable with the hooking member when the exterior cover is in the first posture and disengeagable from the engagement member when the exterior cover is in the second posture.

According to this construction, engagement and disengagement of the hooking member with respect to the engagement member can be performed by changing the posture of the exterior cover.

Accordingly, an image forming apparatus having an exterior cover serving as a handle and an operation lever of a locking mechanism can be realized with a simple construction.

In this case, it is preferable that the exterior cover is supported rotatably against the unit and that the exterior cover is not rotated against the unit substantially in the first posture and is rotated a predetermined angle against the unit in the second posture.

According to this construction, the changing of the posture can be easily made by rotating the exterior cover so that an operability can be improved.

Furthermore, it is preferable that a biasing member which urges the exterior cover in such a direction that the hooking member engages with the engagement member. Accordingly, the locking mechanism can be automatically actuated at the time of inserting the unit so that an operability of insertion is also improved.

Further, if a fixing unit is made the withdrawable unit, a withdrawing or inserting operation of the fixing unit can be made more easily at the time of treating jamming occurred in vicinity of the fixing unit or at the time of replacing the fixing unit.

This application is based on patent application No. 2005-220016 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a main body defining a first portion of an exterior surface of the image forming apparatus;

a unit withdrawably mounted in the main body;

a rail carrying the unit, the rail being withdrawable outwardly from the main body;

a rail guide member in the main body and supporting the rail slidably;

an exterior cover defining a second portion of the exterior surface of the image forming apparatus, said exterior cover being movably attached to the unit for movement between a first posture and a second posture; and a locking mechanism that restricts movement of the unit and the rail when the exterior cover is in the first posture and that allows the unit to be withdrawn from the main body by a pulling force on the exterior cover when the exterior cover is moved to the second posture; and wherein the exterior cover serves as a grip for the unit.

2. An image forming apparatus according to claim 1, wherein the exterior cover is rotatably attached to the unit; and the locking mechanism allows the unit to be withdrawn from the main body when the exterior cover is rotated to the second posture.

3. An image forming apparatus according to claim 2, wherein:

the locking mechanism includes a first member on an inner surface of the exterior cover and a second member in the main body, and the first and second members are engaged when the exterior cover is in the first posture and are disengaged when the exterior cover is in the second posture.

4. An image forming apparatus according to claim 3, further comprising a biasing member which urges the exterior cover in such a direction that the first member engages with the second member.

5. An image forming apparatus according to claim 1, wherein the unit is a fixing unit.

6. An image forming apparatus comprising:

a main body defining a first portion of an exterior surface of the image forming apparatus;

a unit withdrawably mounted in the main body;

a rail carrying the unit, the rail being withdrawable outwardly from the main body;

a rail guide member in the main body and supporting the rail slidably;

an exterior cover defining a second portion of the exterior surface of the image forming apparatus and being rotatably attached to the unit for movement between first and second postures; and a locking mechanism including a first member on an inner surface of the exterior cover and a second member in the main body, the first and second members being engaged when the exterior cover is in the first posture for restricting movement of the unit and the rail, the first and second members being disengaged when the exterior cover is rotated to the second posture so that a pulling force on the exterior cover withdraws the unit from the main body.

7. An image forming apparatus according to claim 1, wherein the first member of the locking mechanism includes a hooking member projecting on the inner surface of the exterior cover.

8. An image forming apparatus according to claim 1, further comprising a biasing member which urges the exterior cover in such a direction that the first member engages with the second member.

9. An image forming apparatus according to claim 1, wherein the unit is a fixing unit.

* * * * *